US011499718B2

(12) United States Patent
Gutowski

(10) Patent No.: US 11,499,718 B2
(45) Date of Patent: Nov. 15, 2022

(54) IGNITER VALVE

(71) Applicant: WOLF STEEL LTD., Barrie (CA)

(72) Inventor: Jan Gutowski, Oro-Medonte (CA)

(73) Assignee: WOLF STEEL LTD, Barrie (CA)

( * ) Notice: Subject to any disclaimer, the term of this patent is extended or adjusted under 35 U.S.C. 154(b) by 169 days.

(21) Appl. No.: 16/490,785

(22) PCT Filed: Mar. 2, 2018

(86) PCT No.: PCT/CA2018/050248
§ 371 (c)(1),
(2) Date: Sep. 3, 2019

(87) PCT Pub. No.: WO2018/157257
PCT Pub. Date: Sep. 7, 2018

(65) Prior Publication Data

US 2020/0003424 A1 Jan. 2, 2020

Related U.S. Application Data

(60) Provisional application No. 62/469,139, filed on Mar. 9, 2017, provisional application No. 62/466,699, filed on Mar. 3, 2017.

(51) Int. Cl.
*F24C 3/12* (2006.01)
*F23Q 3/00* (2006.01)
(Continued)

(52) U.S. Cl.
CPC ..... *F24C 3/12* (2013.01); *F23Q 3/00* (2013.01); *F23Q 9/00* (2013.01); *F24C 3/103* (2013.01)

(58) Field of Classification Search
CPC ... F23Q 2/163; F23Q 3/00; F23Q 3/12; F23D 14/04; F23C 3/103; F23C 3/12
(Continued)

(56) References Cited

U.S. PATENT DOCUMENTS 3,441,450 A * 4/1969 Frommel ..... F23Q 9/04 136/217
3,511,588 A * 5/1970 Wolfe ..... F23Q 3/002 431/264
(Continued)

FOREIGN PATENT DOCUMENTS

CN 201401832 Y 2/2010
KR 200412725 3/2006

OTHER PUBLICATIONS

Energy Audits and Improvements for Commercial Buildings. Ian M. Shapiro 2016 by John Wiley & Sons, Inc. Published by John Wiley & Sons, Inc.*

*Primary Examiner* — Vivek K Shirsat
(74) *Attorney, Agent, or Firm* — DeLio Peterson & Curcio LLC; Brian G. Schlosser

(57) ABSTRACT

Apparatus for igniting a burner of a barbeque includes a housing, a mesh, an orifice, a pair of conductors and a generator. The housing defines a conduit having an inlet and an outlet spaced apart from the inlet. The mesh occludes the conduit and is positioned adjacent the outlet. The orifice is for receiving combustible gas and communicates with the inlet. The pair of conductors define a gap, the gap being positioned such that the gap is disposed in spaced relation to the mesh and the mesh is disposed intermediate the orifice and the gap. The generator is for producing a spark across the gap.

16 Claims, 18 Drawing Sheets

(51) Int. Cl.
*F23Q 9/00* (2006.01)
*F24C 3/10* (2006.01)

(58) Field of Classification Search
USPC ..... 126/25 R, 25 B, 39 E; 431/355
See application file for complete search history.

(56) References Cited

U.S. PATENT DOCUMENTS 3,967,614 A * 7/1976 Stroud ..... B29C 66/91431 126/229
4,846,670 A * 7/1989 Pearl, II ..... F23D 14/70 239/432
5,573,393 A * 11/1996 Tsai ..... F23D 14/28 126/406
5,960,783 A * 10/1999 Schubert ..... F24C 3/103 126/41 R
6,050,811 A 4/2000 Stein

* cited by examiner

IGNITER VALVE

FIELD

The invention relates to the field of barbeques.

BACKGROUND

It is well known to enable gas barbeques with an igniter. A common arrangement is to enable this functionality in the form of an igniter valve, coupling the igniter to the gas supply valve for the burner. However, known igniter valves suffer from an undesirable combination of cost and reliability.

SUMMARY OF THE INVENTION

Forming one aspect of the invention is an improved igniter valve of the type for use with a supply of gas and with a gas burner having a plurality of ports, each of said plurality of ports having a stream of gas-air mixture issuing therethrough in use, the igniter valve being of the type having an assembly, an orifice, a tube and an electrode.

The assembly includes a stem, a generator and a mechanism.

The stem: can be depressed; can turned from an off position toward a low position when depressed; and has a high position between the off and low positions.

The generator produces a high intensity electric field.

The mechanism: is coupled to the generator and to the stem; is coupled in use to the gas supply; has a primary gas port coupled in use to the gas burner; has a secondary gas port; and is adapted to: (i) activate the generator when the stem is turned from the off to the high position; (ii) produce a flow of gas to the secondary gas port when the stem is depressed; and (iii) deliver a stream of gas to the primary gas port when the stem is between the high and low positions.

The orifice is operatively coupled in use to the secondary gas port.

The tube has the orifice positioned thereto such that gas flow issues through a terminus of the tube in use, the tube being positioned such that the terminus lies out of the burner streams while the gas flow intersects at least one of the burner streams.

The electrode is coupled to the generator to produce a spark, the electrode being positioned such that, in use: the spark ignites the gas flow to produce a pilot flame; the pilot flame ignites the burner; and the electrode lies out of the flame of the burner.

The improvement comprises the orifice being disposed adjacent to the terminus.

According to another aspect, the valve can further comprise an insulative holder in which the tube is releasably received.

According to another aspect, the insulative holder can have a notch and further comprise a bracket which releasably engages the notch to secure the holder to the mechanism.

According to another aspect, the valve can further comprise a mesh occluding the terminus of the tube.

According to another aspect, the valve can further comprise a channel: which extends from the secondary gas port to the orifice; in which the orifice is seated; and which is releasably received by the tube.

According to another aspect, the valve can further comprise a wire coupling the electrode to the generator and terminating in a socket and the electrode can have a pin which is releasably received by the socket.

According to another aspect, the valve can further comprise a ground pin which extends to a terminus adjacent the electrode, to propagate the spark, and which is operatively releasably coupled to the assembly.

Forming another aspect of the invention is apparatus for igniting a burner of a barbeque, the apparatus having: a housing defining a conduit having an inlet and an outlet spaced apart from the inlet; a mesh occluding the conduit and being positioned adjacent the outlet; an orifice for receiving gas and communicating with the inlet; and a pair of conductors defining a gap, the gap being positioned such that the gap is disposed in spaced relation to the mesh and the mesh is disposed intermediate the orifice and the gap; and a generator for producing a spark across the gap.

According to another aspect, the conduit can be cylindrical and the orifice can be disposed within the conduit.

According to another aspect, the orifice can have a drill size (diameter) of about 0.026".

According to another aspect, the distance between the orifice and the mesh can be about 0.760".

According to another aspect, the ID of the conduit can be about 0.315".

According to another aspect, the diameter of the outlet can be about 0.236".

According to another aspect, the length of the gap can be about 0.216"

According to another aspect, the distance from the outlet to the gap can be about 0.434"

According to another aspect, the valve can further comprise about 61 ports each with a diameter of about 0.02"

According to another aspect, the valve can further comprise an assembly including a stem and a mechanism.

The stem: can be turned between an off position and a low position; has a high position between the off and low positions; and can be depressed.

The mechanism: is coupled to the generator and to the stem; is coupled in use to the gas supply; has a primary gas port coupled in use to the gas burner; has a secondary gas port; and is adapted to: (i) activate the generator when the stem is turned from the off to the high position; (ii) produce a flow of gas to the secondary gas port when the stem is depressed; and (iii) deliver a stream of gas to the primary gas port when the stem is between the high and low positions.

In this embodiment, the orifice is coupled the secondary gas port such, upon turning the stem from the off to the high position, the spark produces a pilot flame which ignites the burner; and the conductors are positioned in use such the conductors lie outside the flame of the burner.

According to another aspect, the ratio of the distance from outlet to gap (inches) to size of gap (inches) to size of outlet (square inches) can be

| | |
|---|---|
| about | 0.434:.216:.0437 |

According to another aspect, in use, the ratio of the distance from gap to outlet (inches) to the speed of gas leaving outlet (inch/second) can be

| | |
|---|---|
| about | 0.434:21.94 |
| to about | 0.43:24.68 |

According to another aspect, in use, the average speed of gas through the mesh (inch/second) can be

| | |
|---|---|
| about | 496 |
| to about | 558 |

According to another aspect, in use, the average gas velocity (inch/second) in the housing can be

| | |
|---|---|
| about | 12.10 |
| to about | 13.6 |

According to another aspect, in use, the ratio of the cross section of orifice (square inches):cross section of outlet (square inches):distance from orifice to outlet (inches); volumetric flow through housing (cubic feet per hour): distance from gap to outlet (inches) can be

| | |
|---|---|
| about | .000531:.0437:0.819:2.0:0.434 |
| to about | .000531:.0437:0.819:2.25:0.434 |

Other advantages, features and characteristics of the invention will be understood upon review of the following detailed description and the appended drawings, the latter being briefly described hereinafter.

DETAILED DESCRIPTION

An igniter valve 20 of the general type in respect of which the invention is an improvement is shown in FIGS. 1-7.

Figure 1:
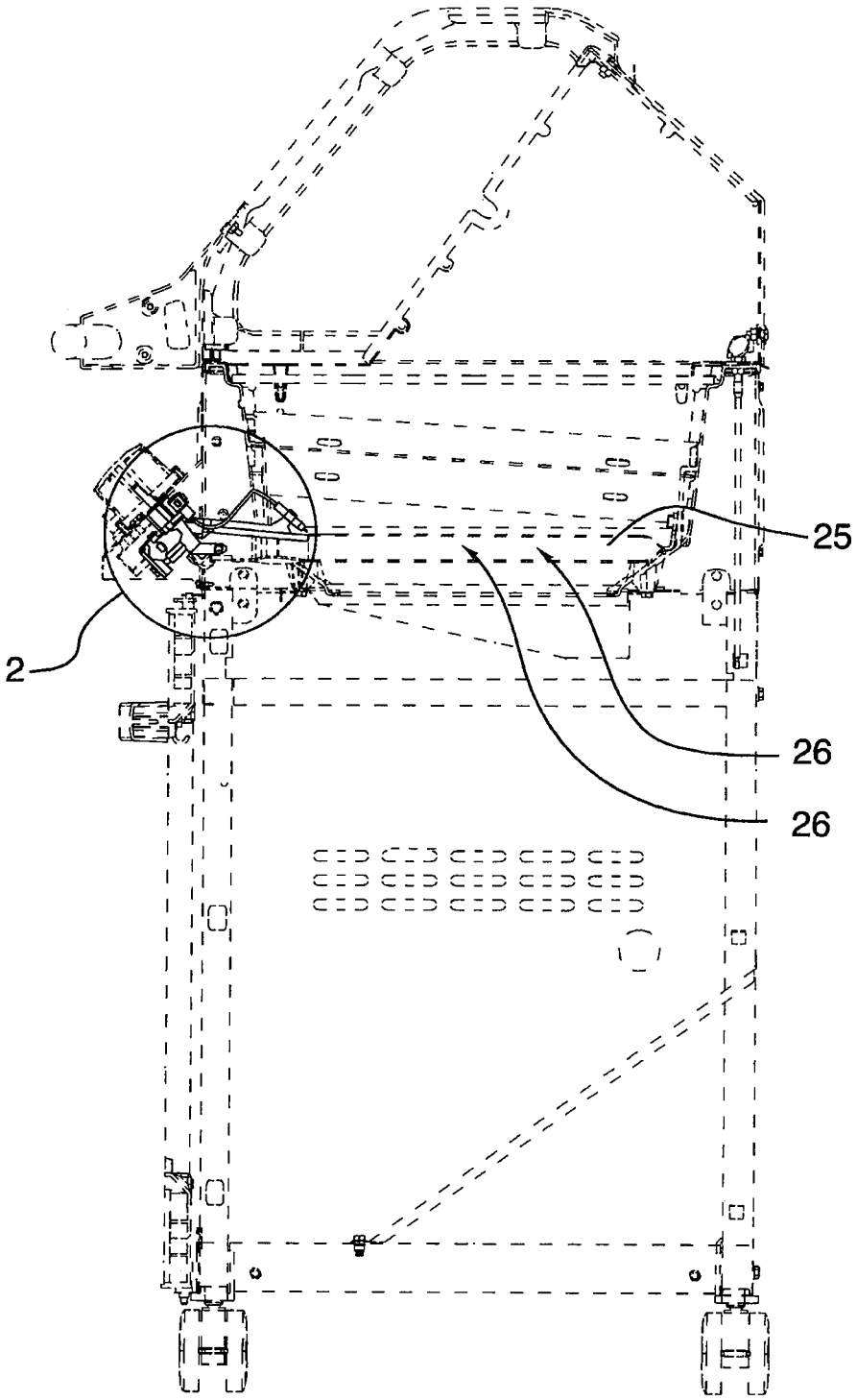
FIG.1 PRIOR ART
FIG. 1 is a side cross sectional view of a prior art barbeque.
Figure 2:
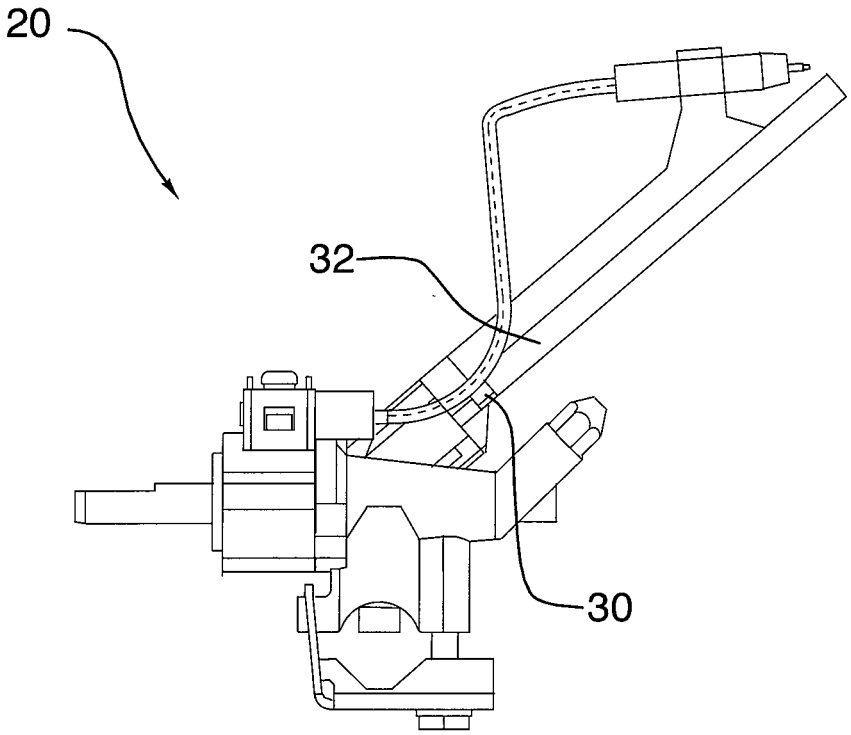
FIG.2 PRIOR ART
FIG. 2 is side view of the structure of encircled area 2 of FIG. 1.
Figure 3:
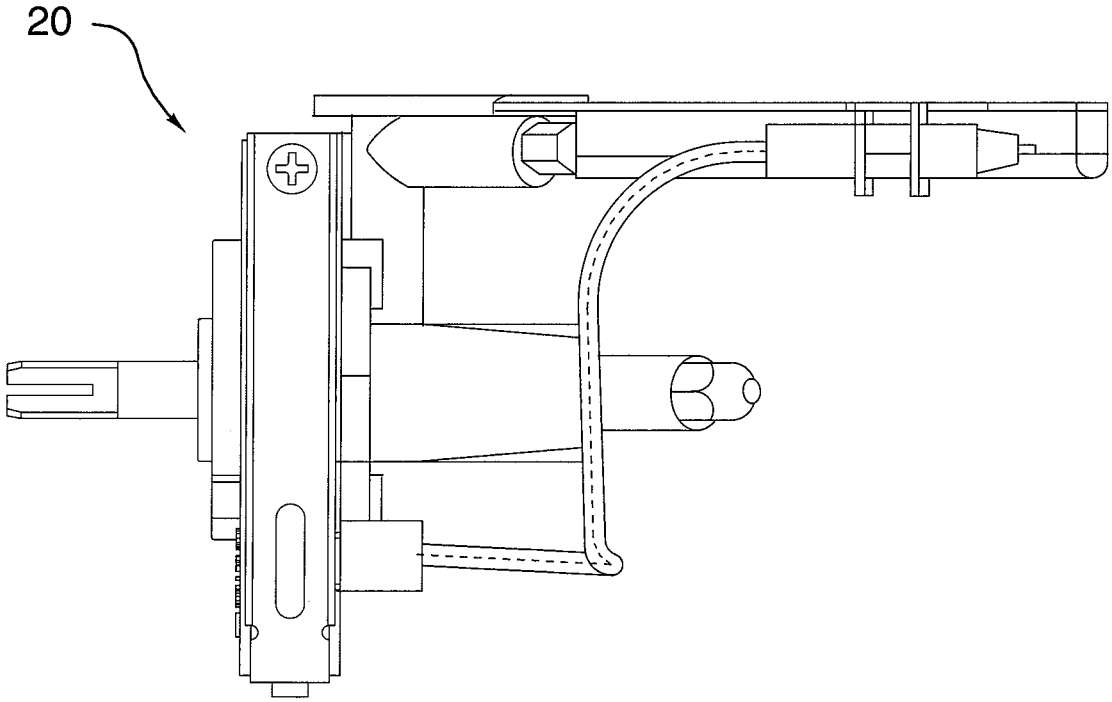
FIG.3 PRIOR ART
FIG. 3 is a top view of the structure of FIG. 2.
Figure 4:
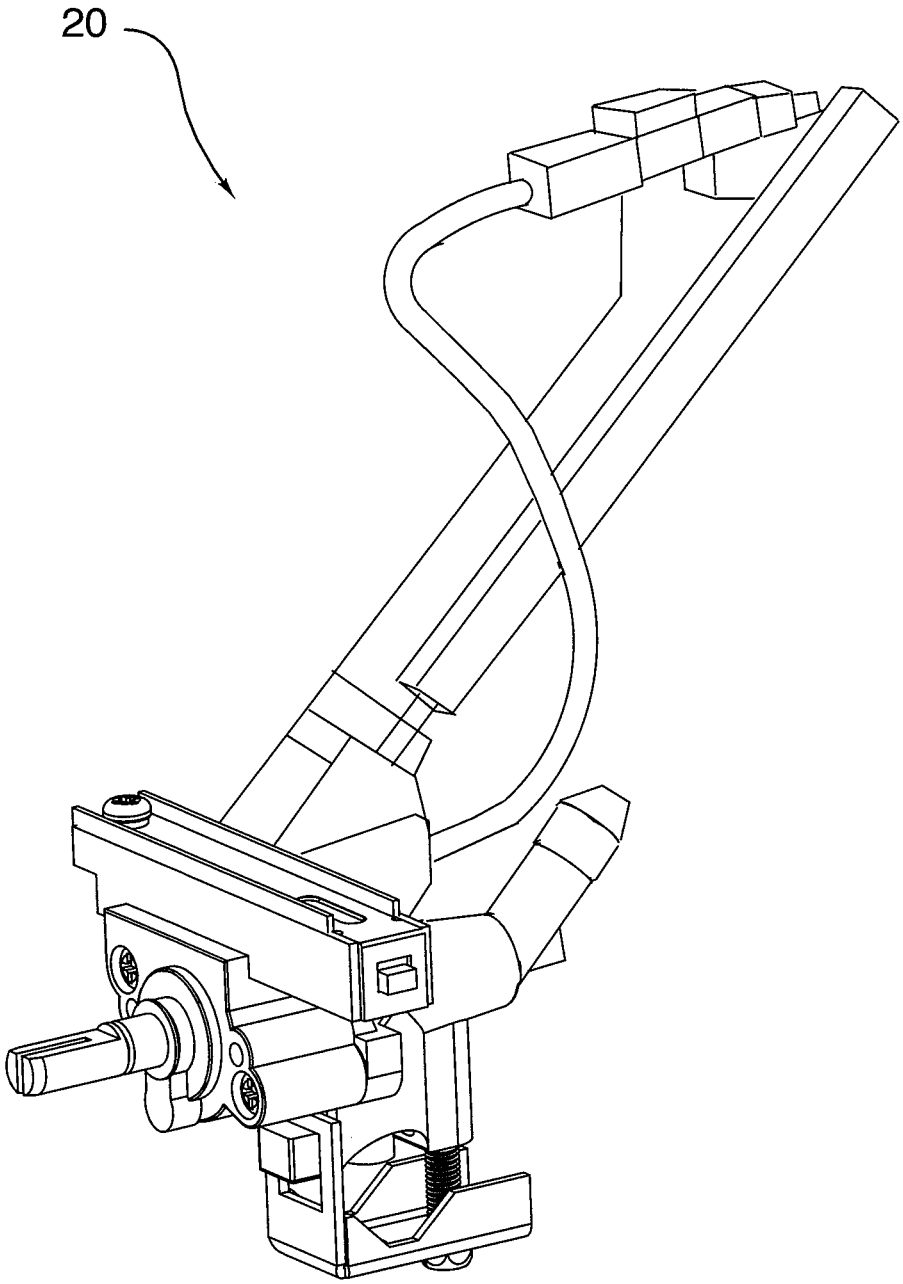
FIG.4 PRIOR ART
FIG. 4 is a perspective view of the structure of FIG. 2.
Figure 5:
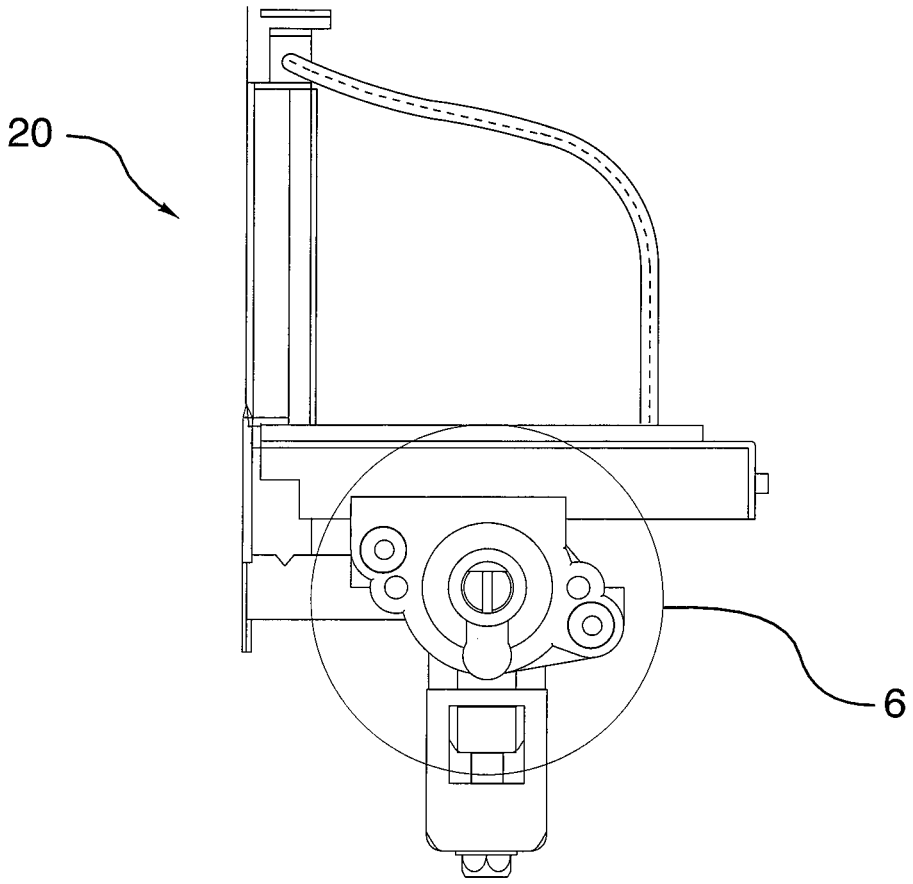
FIG.5 PRIOR ART
FIG. 5 is a front view of the structure of FIG. 2.
Figure 6:
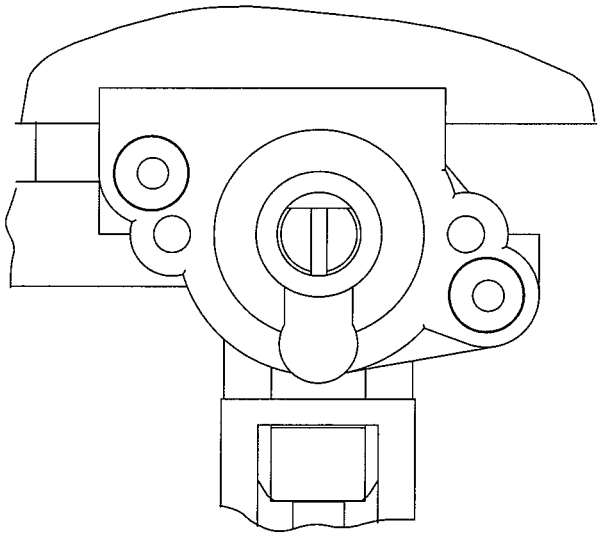
FIG.6 PRIOR ART
FIG. 6 is an enlarged view of encircled area 6 of FIG. 5.
Figure 7:
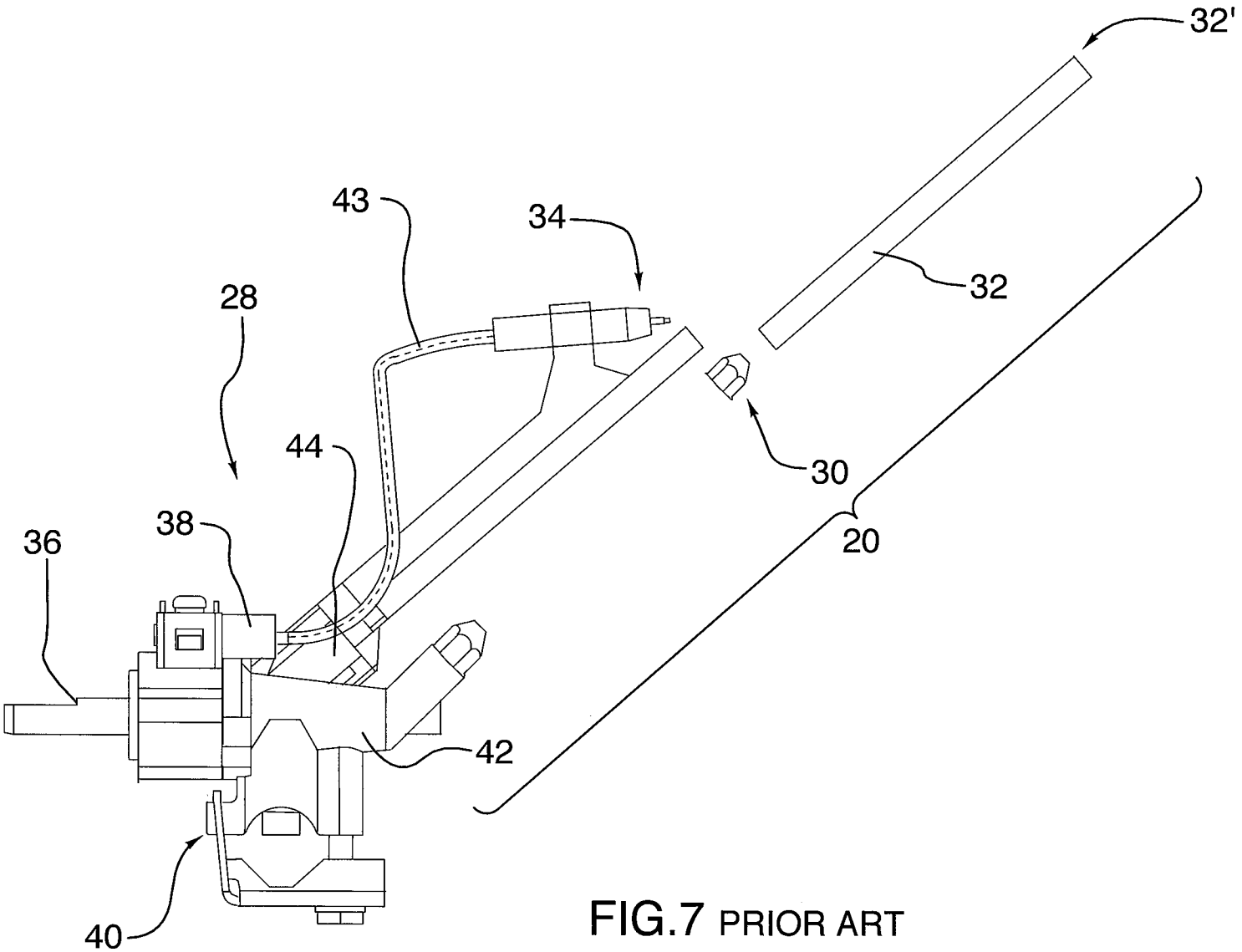
FIG.7 PRIOR ART
FIG. 7 is an exploded view of the structure of FIG. 2.
Figure 8:
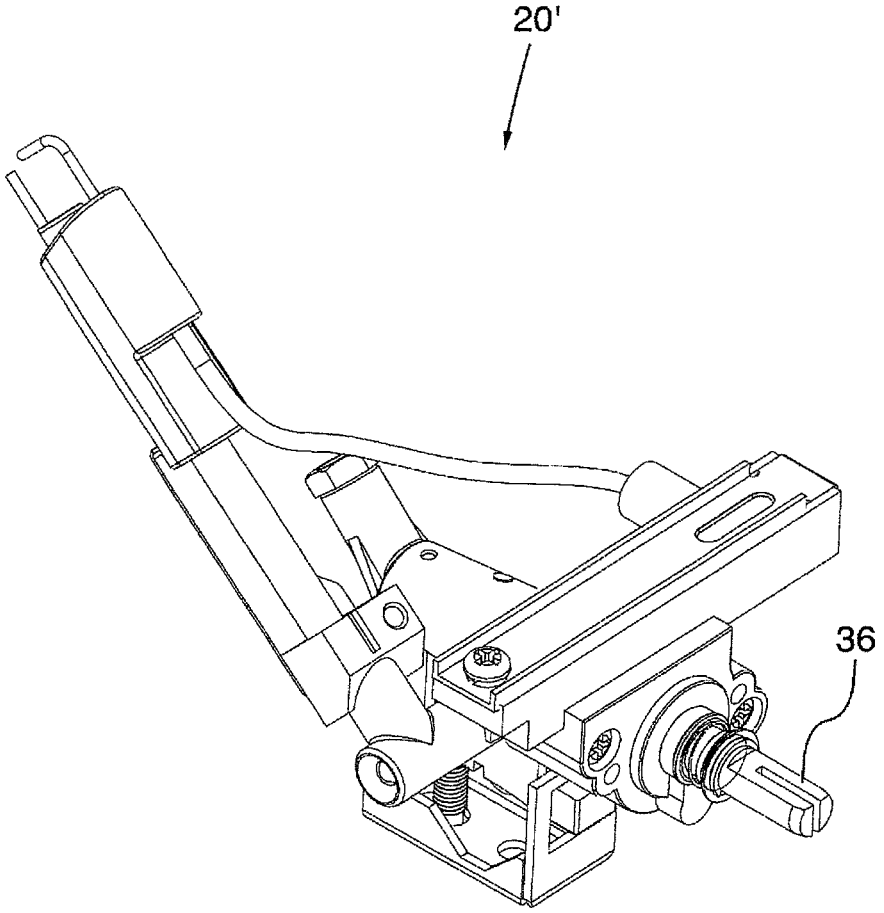
FIG. 8 is a perspective view of an improved igniter valve according to an exemplary embodiment.
Figure 9:
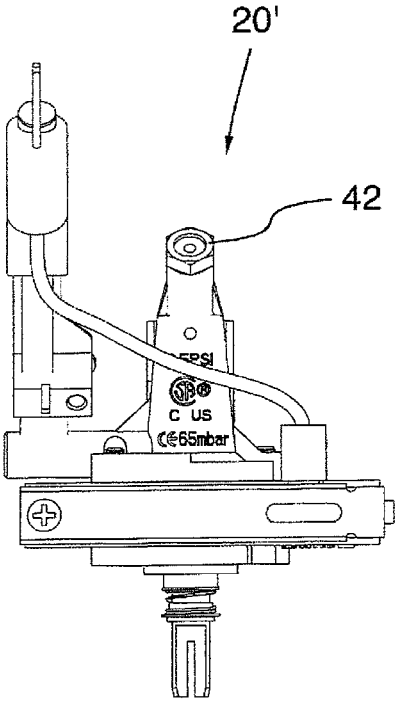
FIG. 9 is another perspective view of the structure of FIG. 8.
Figure 10:
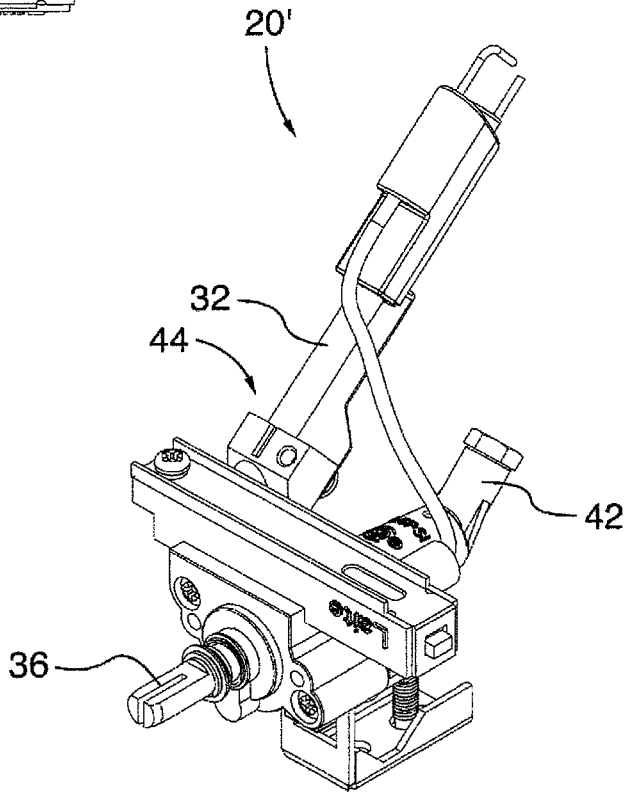
FIG. 10 is another perspective view of the structure of FIG. 8.
Figure 11:
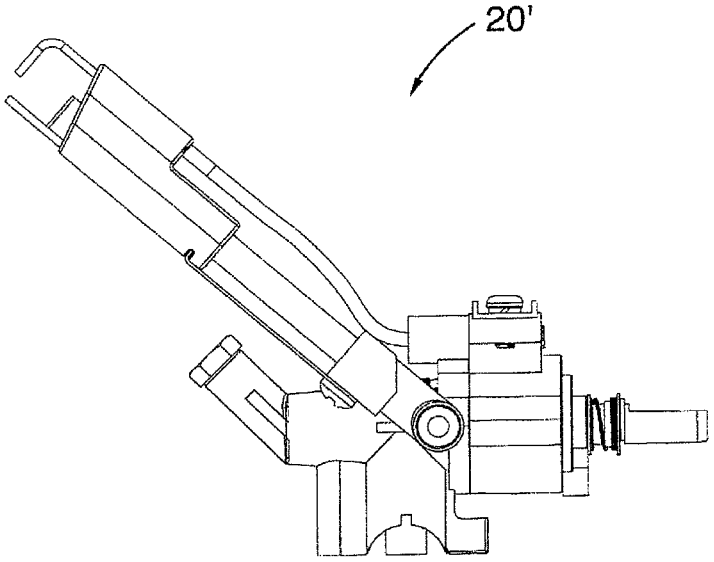
FIG. 11 is another perspective view of the structure of FIG. 8.
Figure 12:
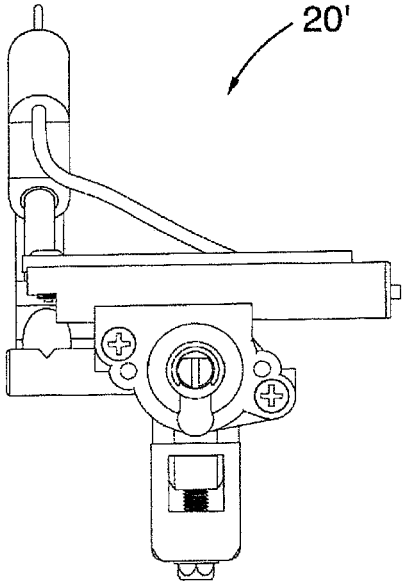
FIG. 12 is another perspective view of the structure of FIG. 8.
Figure 13:
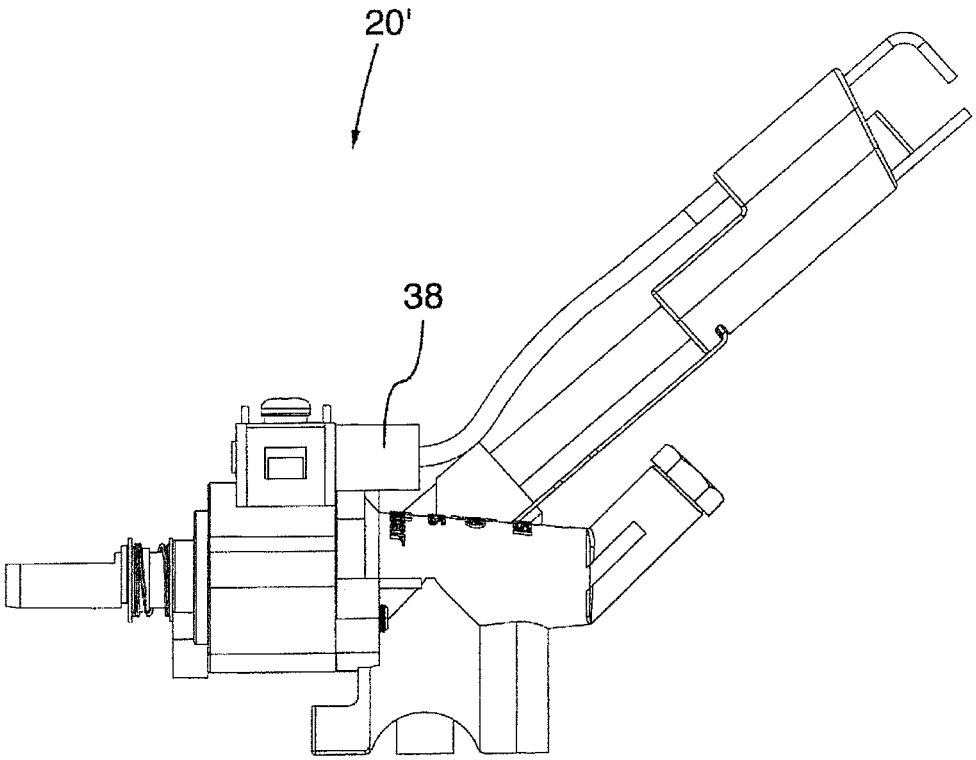
FIG. 13 is another perspective view of the structure of FIG. 8.
Figure 14:
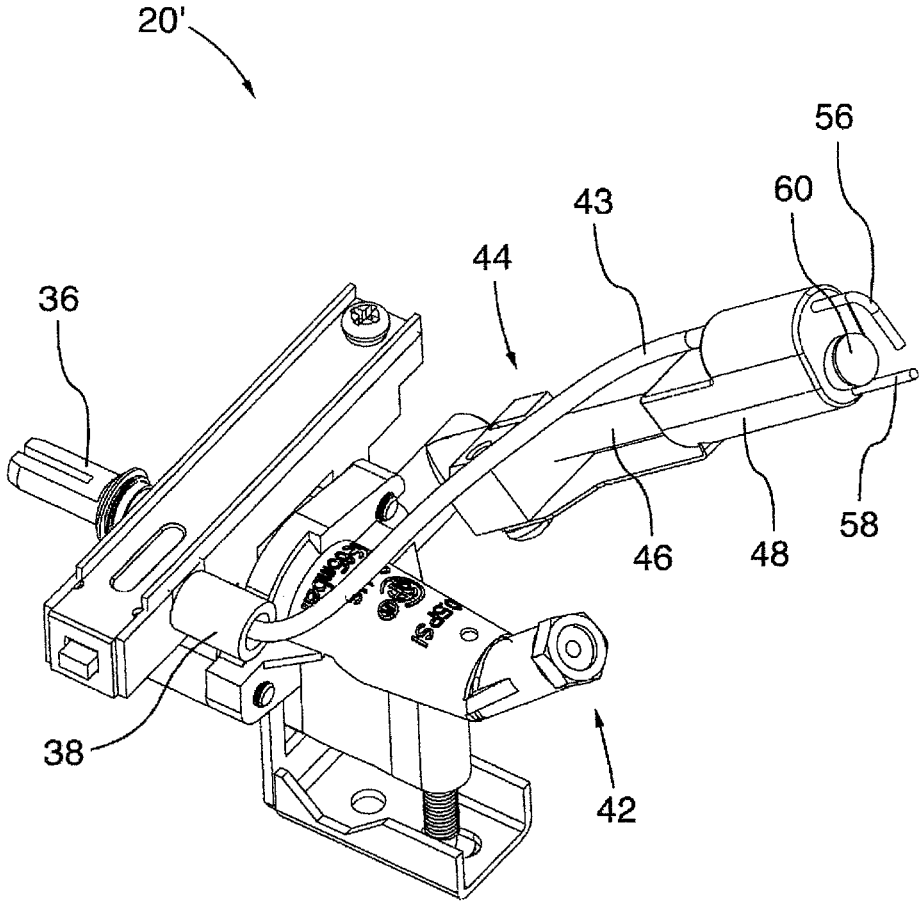
FIG. 14 is another perspective view of the structure of FIG. 8.
Figure 15:
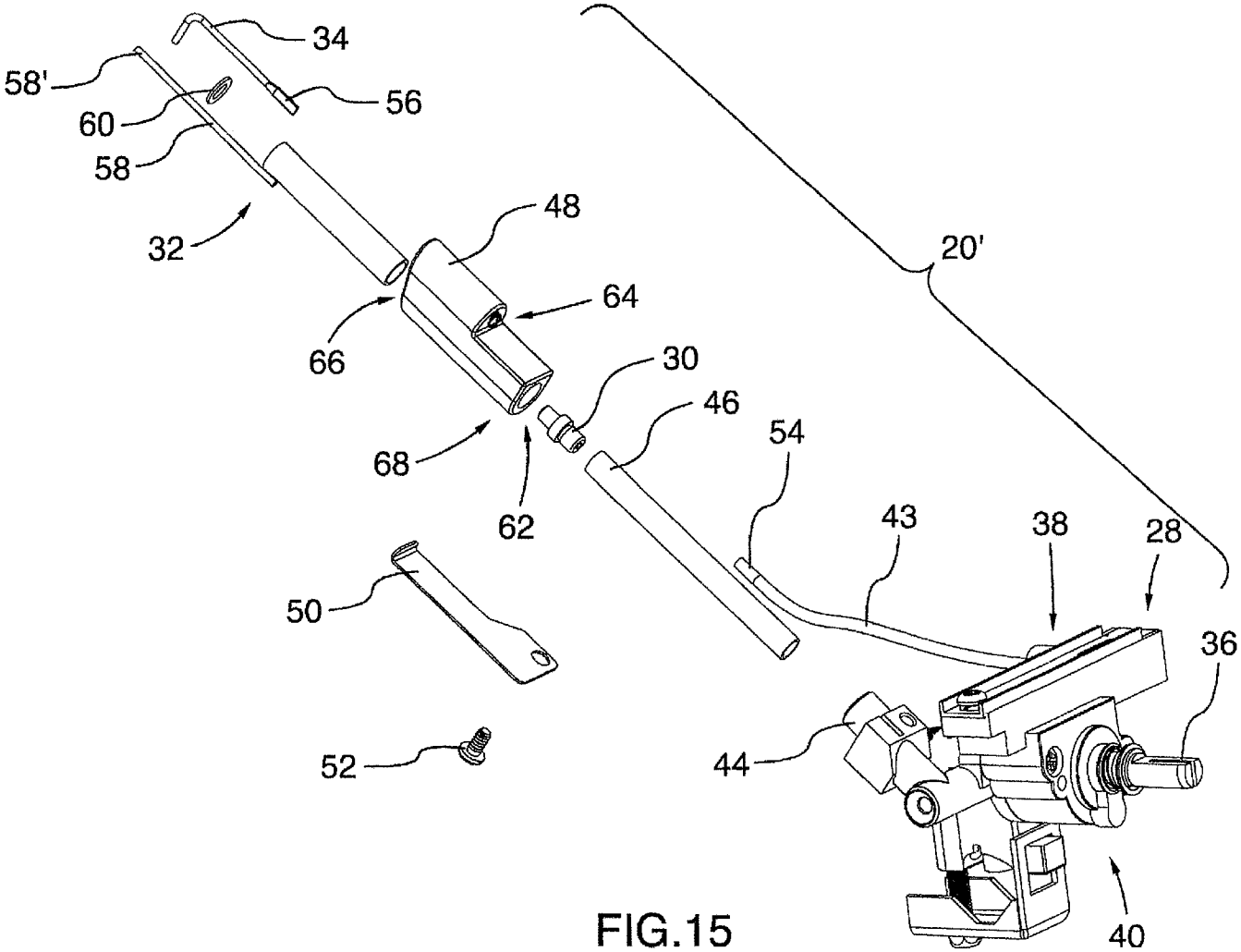
FIG. 15 is an exploded view of the structure of FIG. 8.

FIG. 1 shows the prior art valve 20 in use with a gas grill 22, wherein it will be understood to be used with a supply of gas (not shown) and with a gas burner 25 having a plurality of ports 26, each of said plurality of ports having a stream of gas-air mixture issuing therethrough in use.

FIGS. 2-7 show the prior art valve in isolation, wherein it will be understood to include an assembly 28, an orifice 30, a tube 32 and an electrode 34.

The assembly 28 has a stem 36, a generator 38 and a mechanism 40.

The stem 36: can be turned between an off position and a low position; has a high position between the off and low positions; and can be depressed.

The generator 38 produces a high intensity electric field.

The mechanism 40: is coupled to the generator 38 and to the stem 36; is coupled in use to the gas supply; has a primary gas port 42 coupled in use to the gas burner 25; has a secondary gas port 44; and is adapted to:

- activate the generator 38 when the stem 36 is turned from the off to the high position
- produce a flow of gas to the secondary gas port 44 when the stem 36 is depressed; and
- deliver a stream of gas to the primary gas port 42 when stem 36 is between the high and low positions.

The orifice 30 is operatively coupled in use to the secondary gas port 44 and is positioned in the tube 32.

The tube 32 is positioned such that gas-air flow issues through a terminus 32' of the tube 32 in use and such that the terminus 32' lies out of the burner streams while the gas-air flow intersects at least one of the burner streams.

The electrode 34 is coupled to the generator 38 by a wire 43 to produce a spark, the electrode 34 being positioned such that: the spark ignites the gas-air flow to produce a pilot flame (not shown); the flame ignites the burner 25; and the electrode 34 lies out of the flame of the burner 25.

The improved igniter valve 20', shown in FIG. 8-16, bears the same reference numerals as shown in FIGS. 1-7 and thus will be understood to have all of the foregoing components.

The improved igniter valve 20' notably differs in the presence of a channel 46, a holder 48, a bracket 50, a screw 52, a socket 54, an electrode pin 56, a ground pin 58 and a mesh 60.

Figure 16:
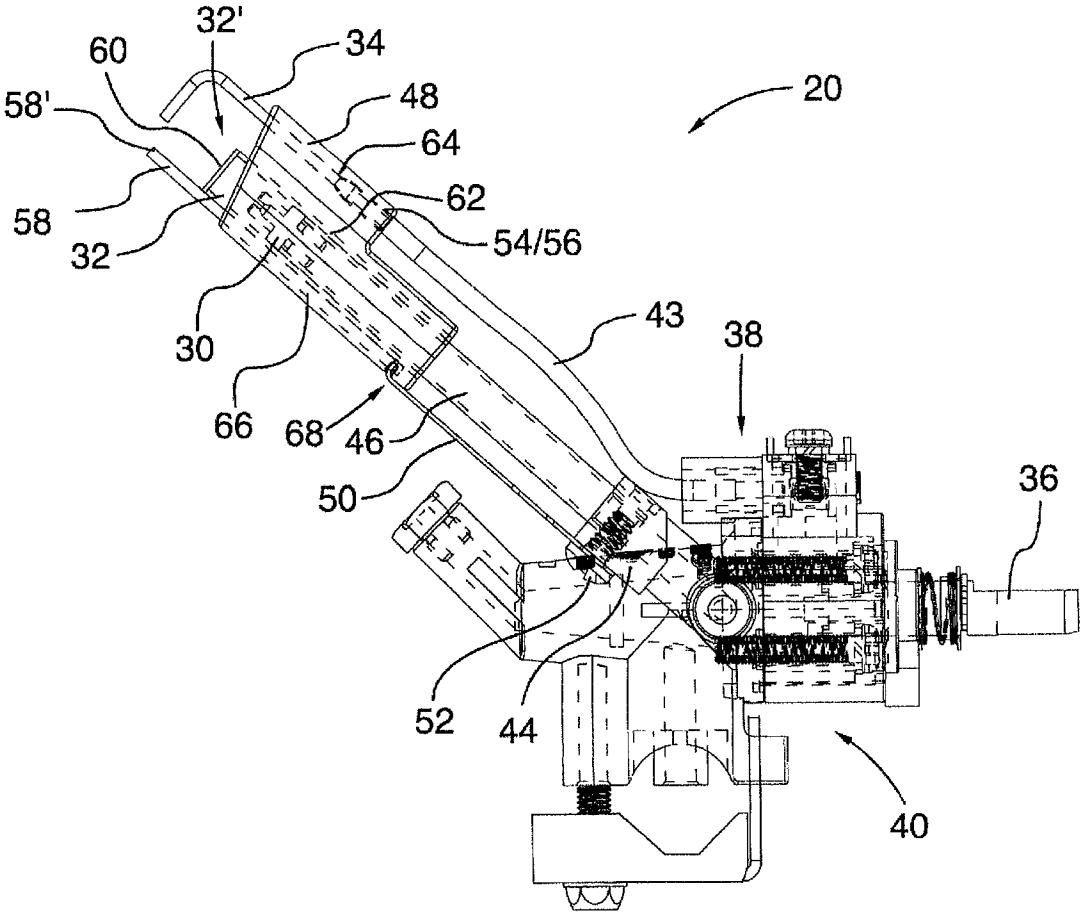
FIG. 16 is a transparent view of the structure of FIG. 11.
Figure 17:
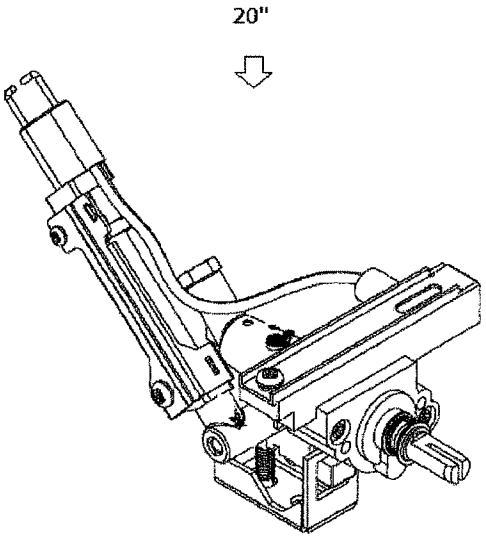
FIG. 17 is a perspective view of an improved igniter valve according to another exemplary embodiment.
Figure 18:
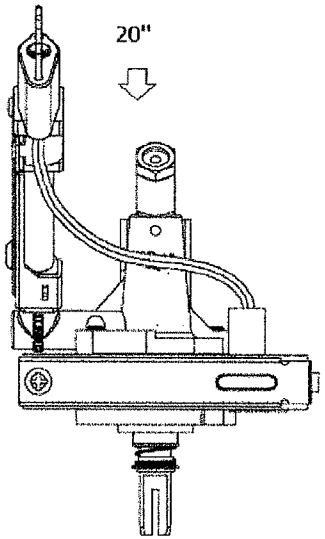
FIG. 18 is another perspective view of the structure of FIG. 17.
Figure 19:
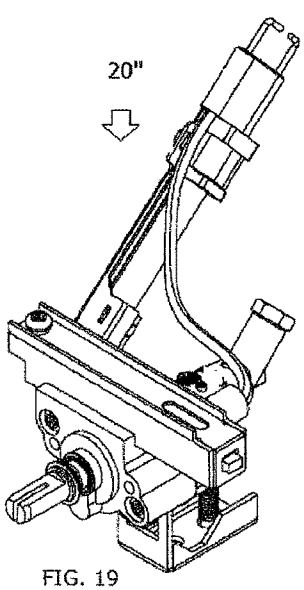
FIG. 19 is another perspective view of the structure of FIG. 17.
Figure 20:
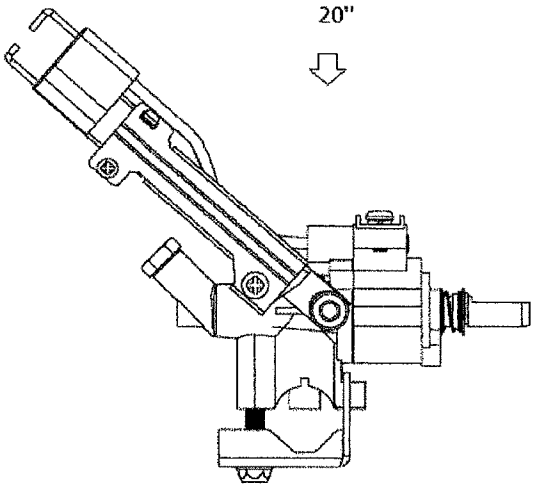
FIG. 20 is another perspective view of the structure of FIG. 17.
Figure 21:
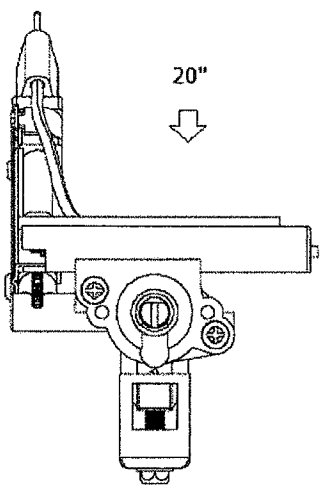
FIG. 21 is another perspective view of the structure of FIG. 17.
Figure 22:
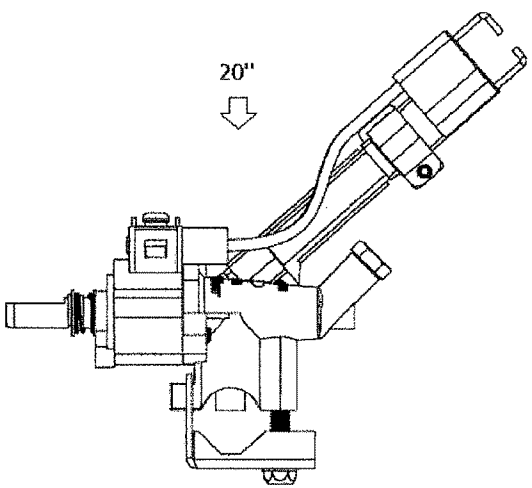
FIG. 22 is another perspective view of the structure of FIG. 17.
Figure 23:
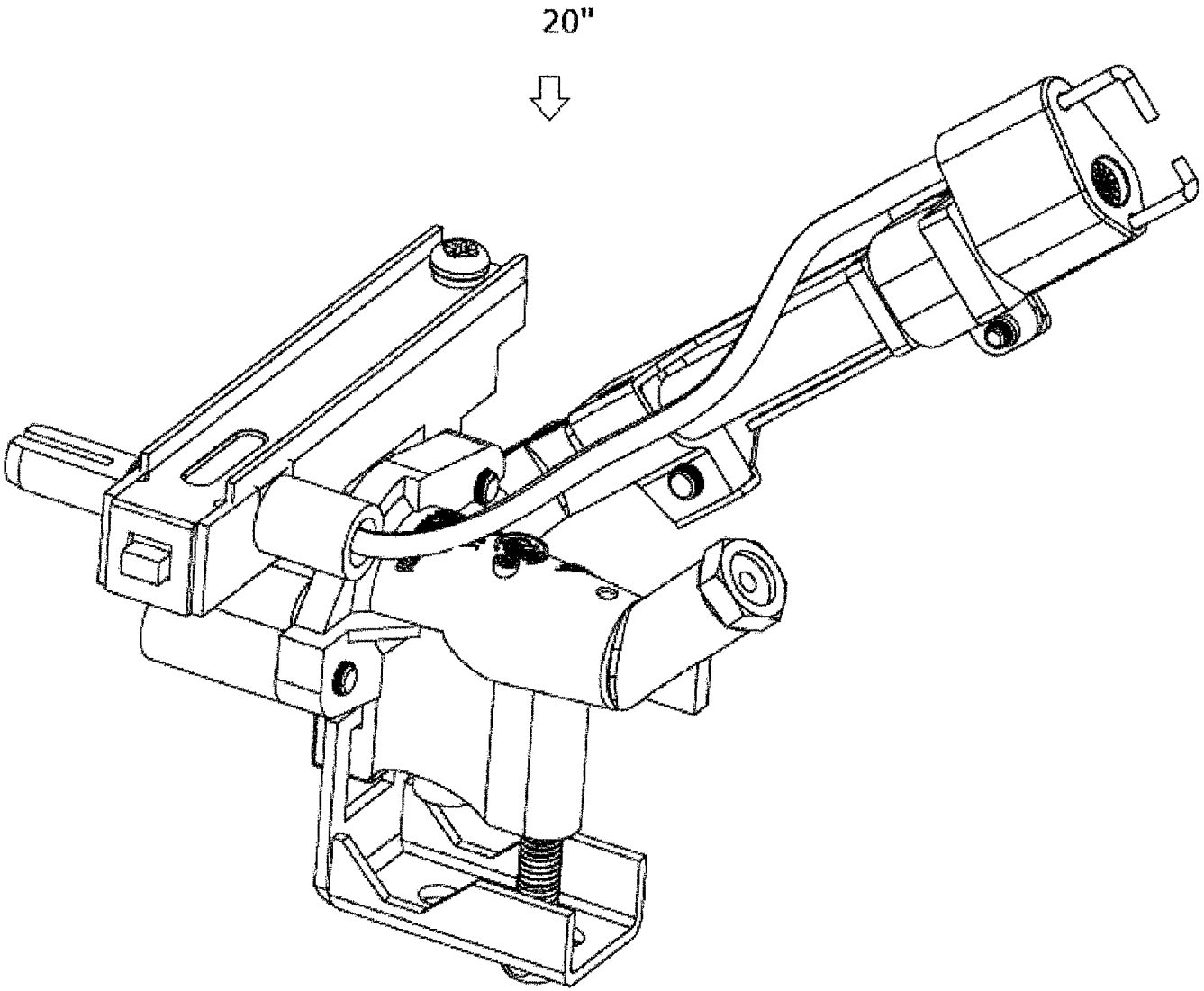
FIG. 23 is another perspective view of the structure of FIG. 17.
Figure 24:
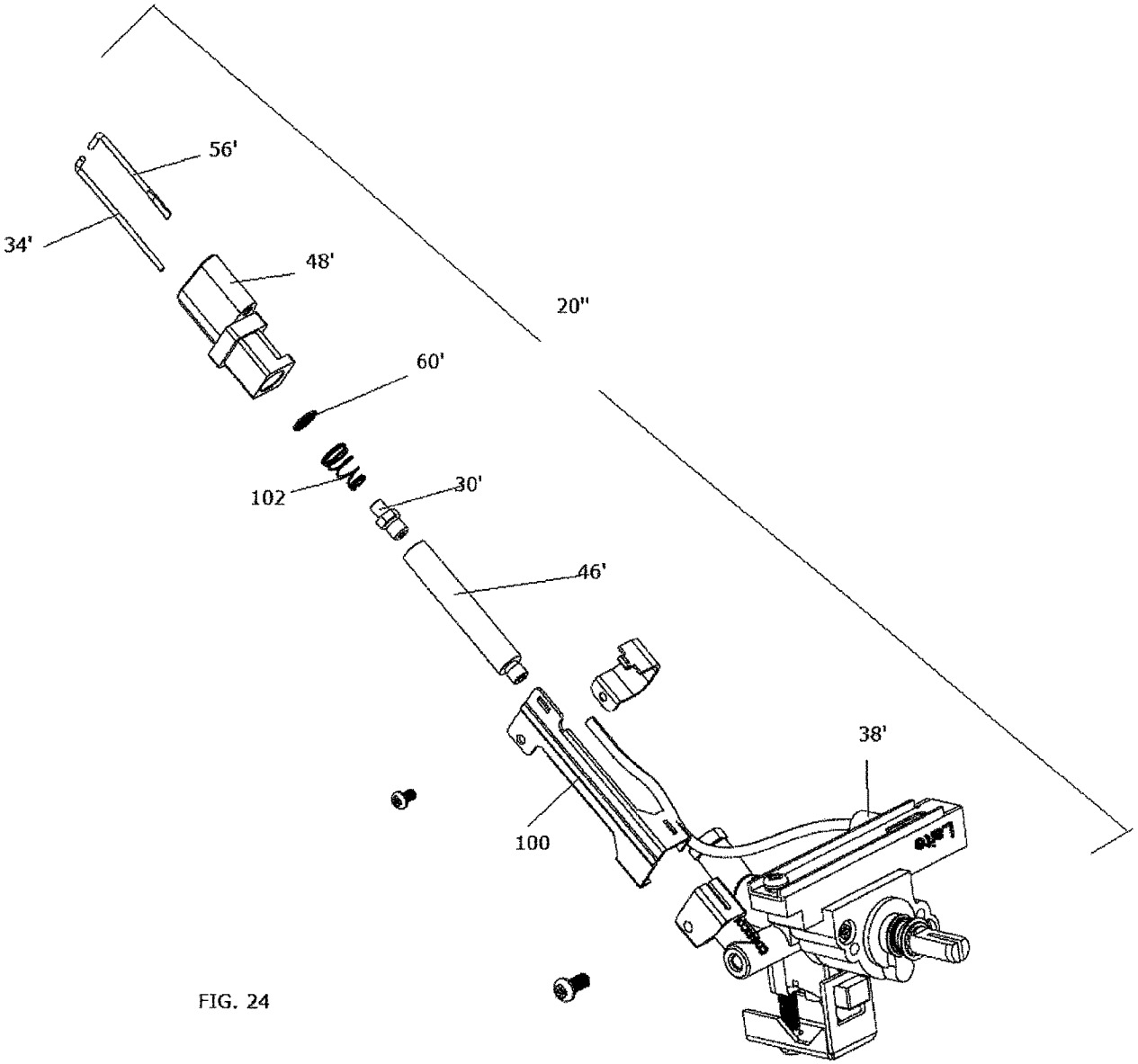
FIG. 24 is an exploded view of the structure of FIG. 17.
Figure 25:
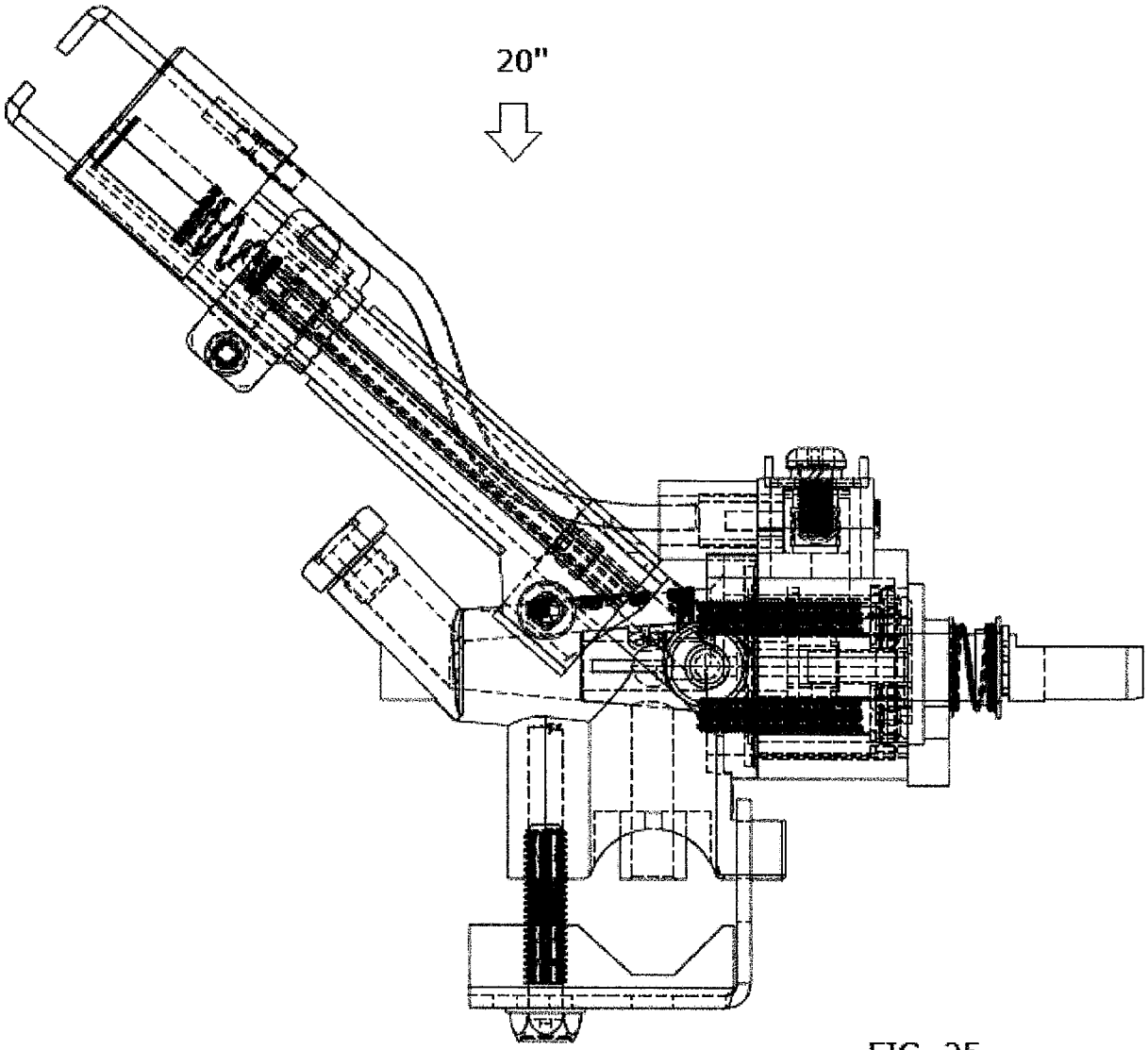
FIG. 25 is a transparent view of the structure of FIG. 17.

The channel 46: extends from the secondary gas port 44 to the orifice 30; has the orifice 30 seated therein; and is releasably received by the tube 32. It will be appreciated that this arrangement places the orifice 30 adjacent to the terminus 32' of the tube 32, as best indicated in FIG. 16.

The holder 48 is a ceramic structure having a passage 62 and an aperture 64 defined therethrough and, defined therein, a groove 66 and a notch 68. The passage 62 is in receipt of the tube 32 and the channel 46 received therewithin.

The bracket 50 is secured by the screw 52 to the assembly 28 at one end and at another end engages the notch 68, to releasably secure the holder 48 to the channel 46.

The socket 54 is positioned at the end of the wire 43 and is disposed in the aperture 64.

The electrode pin 56 is disposed at the end of the electrode 34 and is disposed in press fit relation in the socket 54 such that wire 34 extends into the aperture 64 and the electrode 34 projects from the holder 48.

The ground pin 58 is welded to tube 32, extends to a terminus 58' adjacent the electrode 34, to propagate the spark, and is received by the groove 66.

The mesh 60 is rigidly secured to the end of the tube 32 to occlude terminus 32' of the tube 32.

Another exemplary embodiment of the invention is shown in FIGS. 17-27.

This embodiment functions similarly to that shown in FIGS. 8-16 but differs in construction. This embodiment includes a mesh 60', a ceramic holder 48', a tube 46', an orifice 30', electrode 56', a ground pin 34', a spring 102, a holder bracket 100 and a generator 38'. The holder 48' defines a cylindrical conduit P having an inlet P1 and an outlet P2 spaced apart from the inlet. The mesh 60' occludes the conduit P and is positioned adjacent the outlet P2, being held in place by spring 102. The orifice 30' in this case is disposed in the conduit P within holder 48' to communicate with the inlet P1 and receives gas from tube 46'. The electrode 56' and ground pin 34' are conductive and define a gap J that is positioned such that the gap J is disposed in spaced relation to the mesh 60' and the mesh 60' is disposed intermediate the orifice 30' and the gap J. The generator 38' produces a spark across the gap J. The holder bracket 100 holds tube 48'

Figure 28:
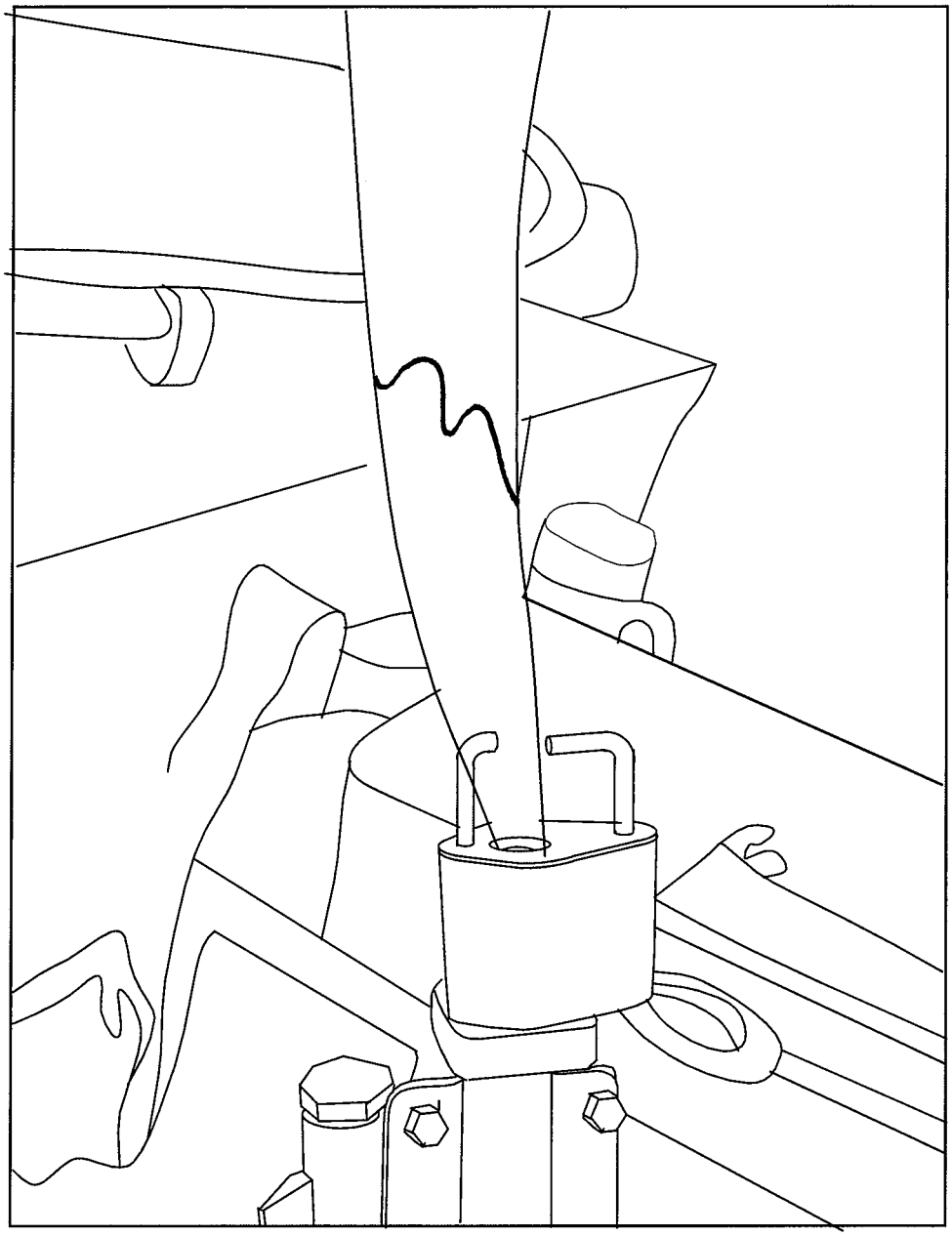
FIG. 28 is a view of the structure of FIG. 17 in use.

Both embodiments produce a reliable flame: the flame of the second embodiment is shown in FIG. 28.

Without intending to be bound by theory, it is believed that the structure of the valve may be responsible for the advantages:

- insects cannot enter the conduit by virtue of the mesh;
- there is little room anywhere in the igniter for insects to nest;
- the gas jet may blow out some of the contaminants which might otherwise accumulate on the screen; and
- the gas flow is such that the flame does not unduly heat the mesh and is reliably ignited by the spark.

Figure 26:
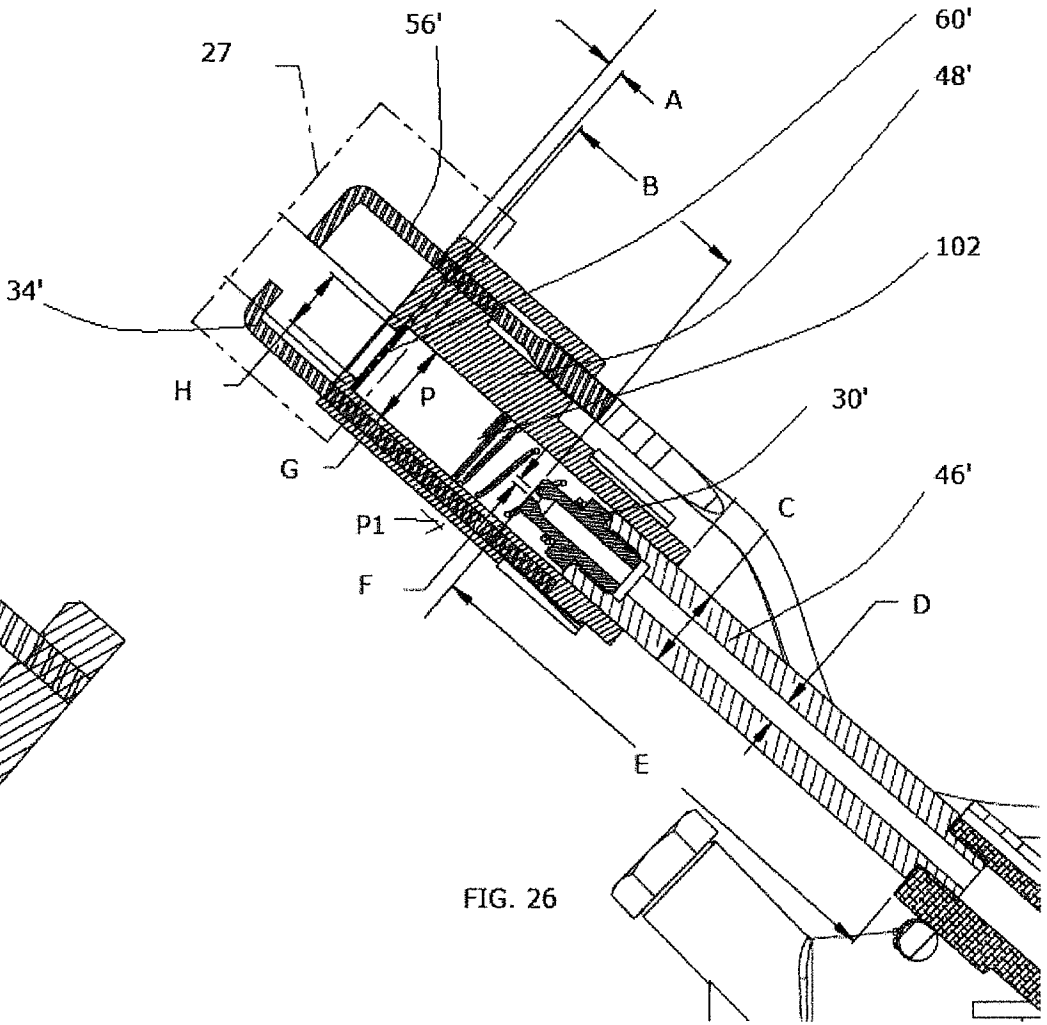
FIG. 26 is an enlarged view of encircled area 26 of FIG. 25.
Figure 27:
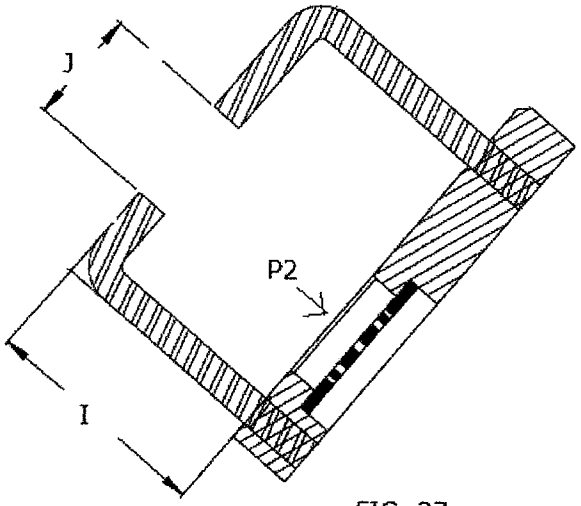
FIG. 27 is an enlarged view of encircled area 27 of FIG. 26.

A dimensioned view of the valve is provided at FIGS. 26, 27, to ensure that persons of ordinary skill in the art can replicate the invention successfully using only the text of this paper and routine common knowledge as a guide. The germane measurements of this valve, which operates well at about 2 cubic foot per hour LPG and 2.25 cubic foot per hour natural gas, are as follows:

| | |
|---|---|
| A | 0.59" |
| B | 0.76" |
| C | .315" |
| D | .094" |
| E | 3.154" |
| F | .026" |
| G | 0.315" |
| H | .236" |
| I | .434" |
| J | .216" |

The mesh herein contains 61 ports, each having a size of 0.02" diameter.

Whereas but two embodiments are herein shown and described, variations are of course possible.

For example, only, whereas the holder is indicated to be ceramic, other non-conductive, temperature-resistant products could be used.

Accordingly, the invention should be understood to be limited only by the accompanying claims, purposively construed.

The invention claimed is:

1. An improved igniter valve of the type for use with a supply of gas and with a gas burner having a plurality of ports, each of said plurality of ports having a stream of gas-air mixture issuing therethrough in use, the igniter valve having:

an assembly including: a stem: that can be turned between an off position and a low position; having a high position between the off and low positions; and that can be depressed; a generator that produces a high intensity electric field; and a mechanism: coupled to the generator and to the stem; coupled in use to the gas supply; having a primary gas port coupled in use to the gas burner; having a secondary gas port; and adapted to (i) activate the generator when the stem is turned from the off to the high position; (ii) produce a flow of gas to the secondary gas port when the stem is depressed; and (iii) deliver a stream of gas to the primary gas port when the stem is between the high and low positions, an orifice operatively coupled in use to the secondary gas port;

a tube positioned in respect to the orifice such that gas flow issues through a terminus of the tube in use, the tube being positioned such that the terminus lies out of the burner streams while the gas flow intersects at least one of the burner streams; and an electrode coupled to the generator to produce a spark, the electrode being positioned such that, in use: the spark ignites the gas-air flow to produce a pilot flame; the pilot flame ignites the burner; and the electrode lies out of the flame of the burner, the improvement comprising: the orifice being disposed adjacent to the terminus; an insulative holder in which the tube is releasably received, a notch defined by the insulative holder and a bracket which releasably engages the notch to secure the holder to the mechanism.

2. A valve according to claim 1, the improvement further comprising a mesh occluding the terminus of the tube.

3. A valve according to claim 1, the improvement further comprising a channel: which extends from the secondary gas port to the orifice; in which the orifice is seated; and which is releasably received by the tube.

4. A valve according to claim 1, the improvement further comprising:

a wire coupling the electrode to the generator and terminating in a socket; and a pin defined by the electrode which pin is releasably received by the socket.

5. Apparatus for igniting a burner of a barbeque, the apparatus having:

a housing defining a conduit having an inlet and an outlet spaced apart from the inlet;

a mesh occluding the conduit and being positioned adjacent the outlet;

an orifice for receiving combustible gas and communicating with the inlet;

a pair of conductors defining a gap, the gap being positioned such that the gap is disposed in spaced relation to the mesh and the mesh is disposed intermediate the orifice and the gap, the distance between the orifice and the mesh being about 0.760"; and a generator for producing a spark across the gap.

6. Apparatus according to claim 5, wherein the conduit is cylindrical and the orifice is disposed within the conduit.

7. Apparatus according to claim 5, wherein the orifice has a drill size (diameter) of about 0.026".

8. Apparatus according to claim 5, wherein the length of the gap is about 0.216".

9. Apparatus according to claim 5, further comprising:

an assembly including a stem: that can be turned between an off position and a low position; having a high position between the off and low positions; and that can be depressed;

a mechanism: coupled to the generator and to the stem; coupled in use to the gas supply; having a primary gas port coupled in use to the gas burner; having a secondary gas port; and adapted to: (i) activate the generator when the stem is turned from the off to the high position; (ii) produce a flow of gas to the secondary gas port when the stem is depressed; and (iii) deliver a stream of gas to the primary gas port when the stem is between the high and low positions, wherein the orifice is coupled the secondary gas port such, upon turning the stem from the off to the high position, the spark produces a pilot flame which ignites the burner; and the conductors are positioned in use such the conductors lie outside the flame of the burner.

10. Apparatus according to claim 9, wherein the ratio of the distance from outlet to gap (inches) to size of gap (inches) to size of outlet (square inches) is 0.434 inches: 0.216 inches: 0.0437 square inches.

11. Apparatus according to claim 9, wherein, in use:

the ratio of the distance from gap to outlet (inches) to the speed of gas leaving outlet (inch/second) is 0.434:21.94 to about 0.43:24.68 or the average speed of gas through the mesh (inch/second) is 496 to 558 or the average gas velocity (inch/second) in the housing is 12.10 to 13.6 or the ratio of the cross section of orifice (square inches): cross section of outlet (square inches): distance from orifice to outlet (inches); volumetric flow through housing (cubic feet per hour): distance from gap to outlet (inches) is 0.000531:0.0437:0.819:2.0:0.434 to 0.000531:0.0437:0.819:2.25:0.434.

12. An improved igniter valve of the type for use with a supply of gas and with a gas burner having a plurality of ports, each of said plurality of ports having a stream of gas-air mixture issuing therethrough in use, the igniter valve having:

an assembly including: a stem: that can be turned between an off position and a low position; having a high position between the off and low positions; and that can be depressed; a generator that produces a high intensity electric field; and a mechanism: coupled to the generator and to the stem; coupled in use to the gas supply; having a primary gas port coupled in use to the gas burner; having a secondary gas port; and adapted to (i) activate the generator when the stem is turned from the off to the high position; (ii) produce a flow of gas to the secondary gas port when the stem is depressed; and (iii) deliver a stream of gas to the primary gas port when the stem is between the high and low positions, an orifice operatively coupled in use to the secondary gas port;

a tube positioned in respect to the orifice such that gas flow issues through a terminus of the tube in use, the tube being positioned such that the terminus lies out of the burner streams while the gas flow intersects at least one of the burner streams; and an electrode coupled to the generator to produce a spark, the electrode being positioned such that, in use: the spark ignites the gas-air flow to produce a pilot flame; the pilot flame ignites the burner; and the electrode lies out of the flame of the burner, the improvement comprising: the orifice being disposed adjacent to the terminus and a ground pin which extends to a terminus adjacent the electrode, to propagate the spark, and which is operatively releasably coupled to the assembly.

13. Apparatus for igniting a burner of a barbeque, the apparatus having:

a housing defining a conduit having an inlet and an outlet spaced apart from the inlet, the conduit having an inner diameter of about 0.315";

a mesh occluding the conduit and being positioned adjacent the outlet;

an orifice for receiving combustible gas and communicating with the inlet;

a pair of conductors defining a gap, the gap being positioned such that the gap is disposed in spaced relation to the mesh and the mesh is disposed intermediate the orifice and the gap; and a generator for producing a spark across the gap.

14. Apparatus for igniting a burner of a barbeque, the apparatus having:

a housing defining a conduit having an inlet and an outlet spaced apart from the inlet, the outlet having a diameter of about 0.236";

a mesh occluding the conduit and being positioned adjacent the outlet;

an orifice for receiving combustible gas and communicating with the inlet;

a pair of conductors defining a gap, the gap being positioned such that the gap is disposed in spaced relation to the mesh and the mesh is disposed intermediate the orifice and the gap; and a generator for producing a spark across the gap.

15. Apparatus for igniting a burner of a barbeque, the apparatus having:

a housing defining a conduit having an inlet and an outlet spaced apart from the inlet;

a mesh occluding the conduit and being positioned adjacent the outlet;

an orifice for receiving combustible gas and communicating with the inlet;

a pair of conductors defining a gap, the gap having a distance from the outlet of about 0.434" the gap being positioned such that the gap is disposed in spaced relation to the mesh and the mesh is disposed intermediate the orifice and the gap; and a generator for producing a spark across the gap.

16. Apparatus for igniting a burner of a barbeque, the apparatus having:

a housing defining a conduit having an inlet and an outlet spaced apart from the inlet;

a mesh occluding the conduit and being positioned adjacent the outlet, the mesh having about 61 ports each with a diameter of about 0.02";

an orifice for receiving combustible gas and communicating with the inlet;

a pair of conductors defining a gap, the gap being positioned such that the gap is disposed in spaced relation to the mesh and the mesh is disposed intermediate the orifice and the gap; and a generator for producing a spark across the gap.

* * * * *